US009309042B2

(12) United States Patent
Digregorio et al.

(10) Patent No.: US 9,309,042 B2
(45) Date of Patent: Apr. 12, 2016

(54) LIQUID DISPENSING SYRINGE AND METHOD FOR REDUCING PISTON BOUNCE

(71) Applicant: Nordson Corporation, Westlake, OH (US)

(72) Inventors: Henry Digregorio, Westerly, RI (US); James A. Gadol, Pawtucket, RI (US); Jeff Groene, Coventry, RI (US)

(73) Assignee: NORDSON CORPORATION, Westlake, OH (US)

( * ) Notice: Subject to any disclaimer, the term of this patent is extended or adjusted under 35 U.S.C. 154(b) by 0 days.

(21) Appl. No.: 14/281,296

(22) Filed: May 19, 2014

(65) Prior Publication Data

US 2014/0367409 A1 Dec. 18, 2014

Related U.S. Application Data

(60) Provisional application No. 61/869,929, filed on Aug. 26, 2013, provisional application No. 61/835,226, filed on Jun. 14, 2013.

(51) Int. Cl.

| | |
|---|---|
| ***B67D 7/60*** | (2010.01) |
| ***G01F 11/00*** | (2006.01) |
| ***B65D 83/00*** | (2006.01) |

(52) U.S. Cl.

CPC ..... *B65D 83/0005* (2013.01)

(58) Field of Classification Search

CPC .... B65D 83/0005; B65D 83/62; B65D 83/64; B05C 5/0225; B67D 1/0412; A01C 7/18; F16N 3/12

USPC ..... 222/386, 1, 389, 386.5, 399, 327, 328, 222/326; 604/218, 187

See application file for complete search history.

(56) References Cited

U.S. PATENT DOCUMENTS

| | | | | |
|---|---|---|---|---|
| 3,367,545 | A * | 2/1968 | Cook | 222/389 |
| 4,452,370 | A * | 6/1984 | Langensiepen et al. | 222/327 |
| 4,634,027 | A * | 1/1987 | Kanarvogel | 222/380 |
| 4,940,166 | A * | 7/1990 | Pidgeon | 222/136 |
| 5,360,146 | A * | 11/1994 | Ikushima | 222/386 |

(Continued)

FOREIGN PATENT DOCUMENTS

| | | | |
|---|---|---|---|
| JP | 5101743 | * | 12/2012 |
| JP | 5101743 B1 | | 12/2012 |

OTHER PUBLICATIONS

JP 5101743—machine generated english translation, Mar. 2015.*

*Primary Examiner* — J. Casimer Jacyna
*Assistant Examiner* — Benjamin R Shaw
(74) *Attorney, Agent, or Firm* — Baker & Hostetler LLP

(57) ABSTRACT

A liquid dispensing syringe and method for reducing piston bounce includes a barrel and a piston. The barrel defines an interior reservoir having an inner surface. The piston is disposed within the interior reservoir and has a proximal end and an elastic portion configured to expand under the influence of a pressurized gas. A first circumferentially extending wiper seal is positioned on the piston. The first wiper seal liquidly seals against the inner surface. A second circumferentially extending wiper seal is positioned on the piston proximally from the first wiper seal on the elastic portion. As such, the expanding elastic portion forces the second wiper seal to fluidly sealing against the inner surface for inhibiting the pressurized gas from flowing distally beyond the second wiper seal in order to reduce piston bounce.

14 Claims, 6 Drawing Sheets

(56) References Cited

U.S. PATENT DOCUMENTS

| | | | | | |
|---|---|---|---|---|---|
| 5,397,313 | A * | 3/1995 | Gross | 604/218 |
| 5,522,526 | A * | 6/1996 | DeLaforcade et al. | 222/1 |
| 5,735,825 | A * | 4/1998 | Stevens et al. | 604/218 |
| 5,887,764 | A * | 3/1999 | Ennis et al. | 222/389 |
| 6,334,553 | B1 * | 1/2002 | Bouras et al. | 222/386 |
| 7,458,487 | B1 * | 12/2008 | Ikushima | 222/389 |
| 7,878,377 | B2 | 2/2011 | Ikushima | |
| 2002/0145011 | A1 * | 10/2002 | Schrader | 222/179 |
| 2007/0287965 | A1 * | 12/2007 | Strong et al. | 604/218 |
| 2011/0089200 | A1 * | 4/2011 | Reuter | 222/387 |
| 2012/0247323 | A1 * | 10/2012 | Obrist | 92/175 |

* cited by examiner

LIQUID DISPENSING SYRINGE AND METHOD FOR REDUCING PISTON BOUNCE

This application claims the benefit of U.S. Provisional Patent Application Ser. No. 61/835,226, filed on Jun. 14, 2013 (pending) and U.S. Provisional Patent Application Ser. No. 61/869,929, filed Aug. 26, 2013 (pending), the disclosures of which are incorporated by reference herein in their entirety.

TECHNICAL FIELD

The present invention relates generally to the field of dispensing liquid materials, and more particularly to a syringe for dispensing liquid materials.

BACKGROUND

Various types of dispensers are used in many industries for placing liquids, such as adhesives, conformal coating materials, solder paste, solder flux, and other similar materials, onto substrates during an assembly process. One type of liquid dispenser is a syringe-type dispenser having a dispenser body defining a barrel reservoir for holding a supply of liquid material to be dispensed. A dispensing tip is coupled to the syringe at one end, and is in fluid communication with the reservoir. A piston disposed in the reservoir is movable therein to pressurize the liquid in the reservoir and thereby dispense a small amount of liquid from the dispensing tip and onto a substrate.

Many industrial applications require that the liquid be dispensed in very precise volumes and at precise locations. To this end, liquid dispensers include actuators for moving the piston within the reservoir in a controllable and predictable manner. For instance, pneumatic actuators are known in the art and use compressed gas, such as air, applied to the piston to move the piston and dispense liquid from the dispenser. Those skilled in the art will recognize that other types of actuators, such as linear actuators, may be used to control movement of the piston within the reservoir. In other applications where precise dispensing is not required, the piston may be moved through manual processes.

Often times, pneumatic actuators are prone to a phenomenon known as "piston bounce." Piston bounce generally refers to the accumulation of entrapped gas between the piston and the liquid. Thus, when the piston is actuated by the compressed gas, the piston effectively "bounces" on the entrapped gas before contacting the liquid within the dispenser. The effects of piston bounce decrease performance of the liquid dispenser and may range from minor inconsistencies in the dispensed liquid to a tunneling of the liquid within the liquid dispenser that may require disposal of the remaining liquid.

Traditional solutions for improving performance of such liquid dispensers often attempt to balance piston bounce with liquid waste. Specifically, the piston may include or at least partially define passages such as vents, micro-vents, flow channels, or increased clearances to direct entrapped gas from the liquid, beyond the piston, and into an ambient environment. While relatively effective at reducing piston bounce, these passages also tend to release liquid that, in turn, creates significant waste.

There is a need for a liquid dispensing syringe and method for reducing piston bounce that effectively dispenses liquid while addressing issues such as those discussed above.

SUMMARY

An exemplary embodiment of a liquid dispensing syringe for reducing piston bounce includes a piston slidably disposed within an interior reservoir of a barrel. The barrel also includes a first end and a second end, and the interior reservoir has an inner surface. The piston has a distal end, a proximal end, and an elastic portion. The proximal end is configured to receive a pressurized gas and move the piston toward the first end of the barrel. As such, the moving piston decreases a volume of the interior reservoir proximate to the first end of the barrel and discharges a liquid contained therein. The elastic portion is configured to expand under the influence of the pressurized gas. Furthermore, the liquid dispensing syringe includes first and second circumferentially extending wiper seals. The first wiper seal is positioned on the piston between the distal and proximal ends and engages the inner surface such that the first wiper seal liquidly seals against the inner surface. Accordingly, the first wiper seal inhibits the liquid within the interior reservoir from flowing proximally beyond the first wiper seal. The second wiper seal is positioned on the elastic portion of the piston proximally from the first wiper seal such that the expanding elastic portion forces the second wiper seal to fluidly seal against the inner surface. Accordingly, the second wiper seal inhibits pressurized gas from flowing distally beyond the second wiper seal in order to reduce piston bounce.

According to another exemplary embodiment, a piston for reducing piston bounce within a barrel includes a body configured to be slidably positioned within the barrel. The body includes a distal end, a proximal end, and an elastic portion. The proximal end is configured to receive a pressurized gas such that the body moves toward a first end in order to decrease a volume of an interior reservoir. The elastic portion is configured to expand under the influence of the pressurized gas. The piston also includes first and second circumferentially extending wiper seals positioned on the body. The first wiper seal is configured to liquidly seal against the inner surface. Accordingly, the first wiper seal inhibits the liquid within the interior reservoir from flowing proximally beyond the first wiper seal. The second wiper seal is positioned on the elastic portion of the body proximally from the first wiper seal. The expanding elastic portion of the body is configured to force the second wiper seal to fluidly seal against the inner surface. Accordingly, the second wiper seal inhibits pressurized gas from flowing distally beyond the second wiper seal in order to reduce piston bounce.

A method of reducing piston bounce of a piston within an interior reservoir of a dispensing syringe comprises engaging a first wiper seal against an inner surface of the interior reservoir such that the first wiper seal liquidly seals against the inner surface. The method also includes applying a pressurized gas to an elastic portion of the piston to expand the elastic portion and force the second wiper seal to fluidly seal against the inner surface of the interior reservoir. As such, the second wiper seal inhibits pressurized gas from moving distally beyond the second wiper for reducing piston bounce.

Various additional objectives, advantages, and features of the invention will be appreciated from a review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
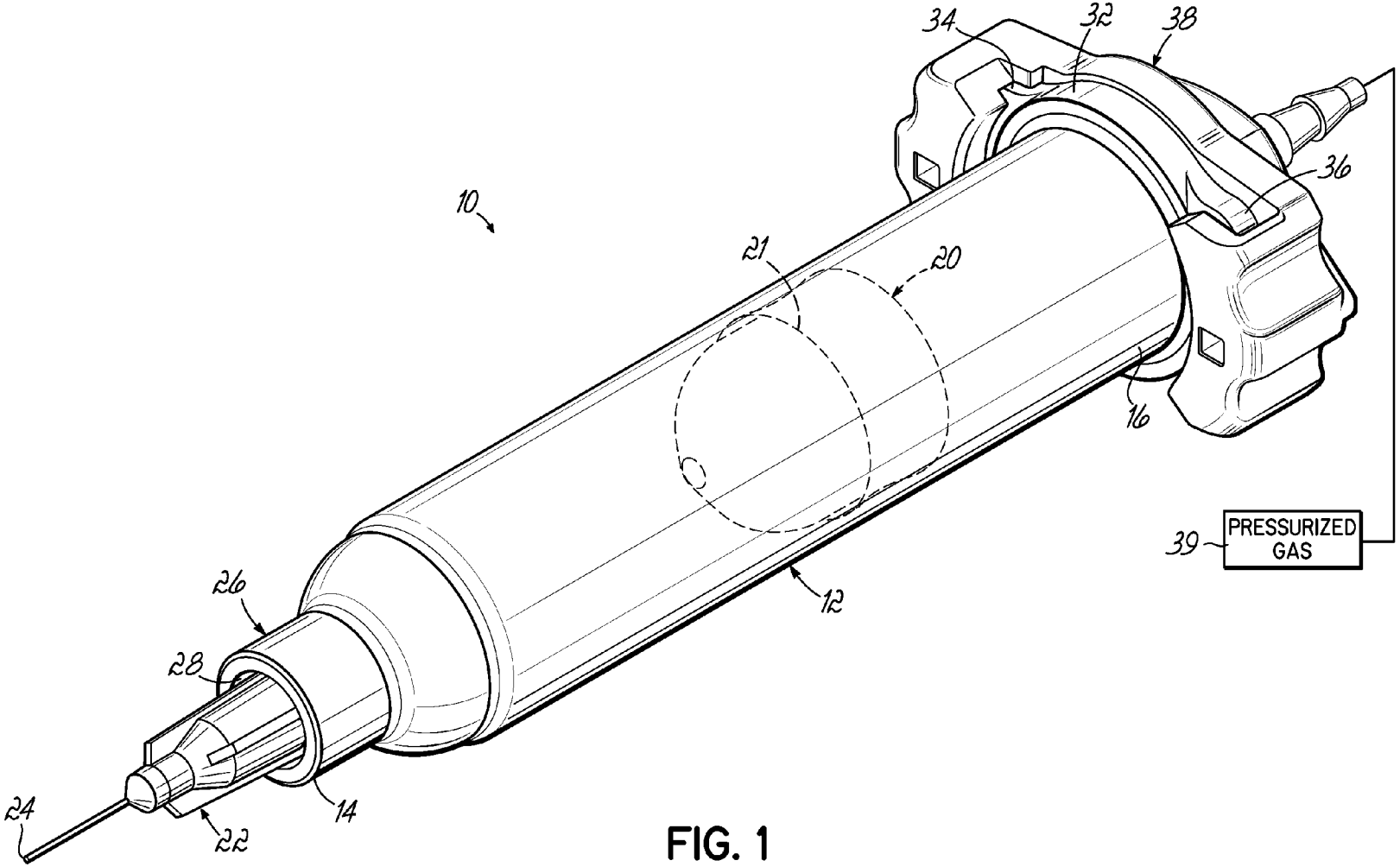
FIG. 1 is a perspective view of an exemplary dispensing syringe.
Figure 2:
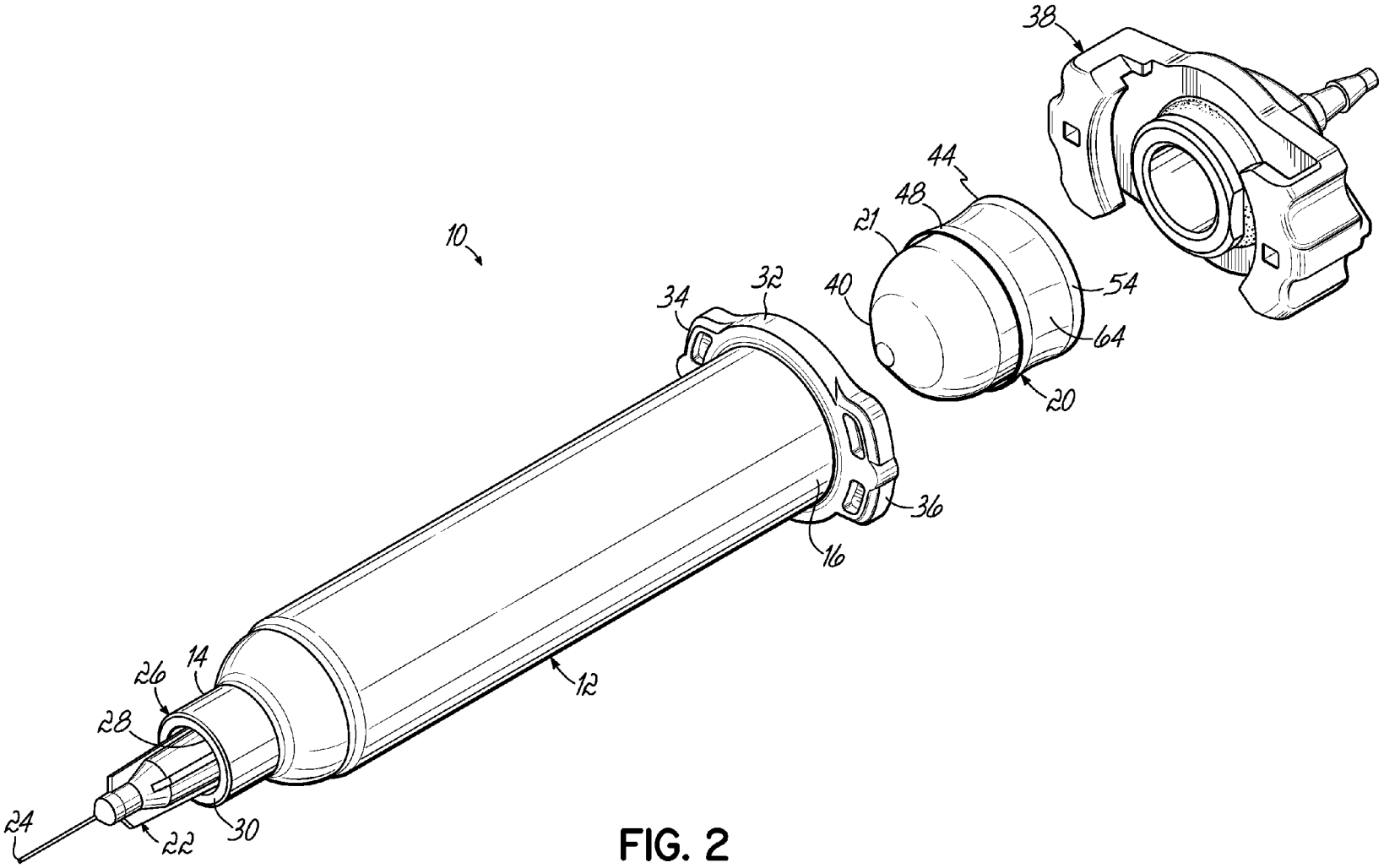
FIG. 2 is an exploded perspective view of the dispensing syringe of FIG. 1.

With reference to FIG. 1 and FIG. 2, an exemplary liquid dispensing syringe 10 comprises a generally elongate syringe barrel 12 having a first end 14 for dispensing liquid material therefrom, and a second end 16 opposite the first end 14. The barrel 12 defines an interior reservoir 18 (see FIG. 3A) for containing the liquid material to be dispensed from the first end 14. A piston 20 having a body 21 is slidably disposed within the interior reservoir 18 and is slidably movable therein between the first and second ends 14, 16 to dispense liquid material from the first end 14 as the piston 20 moves in a direction toward the first end 14. A dispensing tip 22 is removably coupled to the first end 14 of the barrel 12 for communication with the interior reservoir 18 such that liquid material may be dispensed from an outlet 24 of the dispensing tip 22. According to an exemplary embodiment, the barrel 12 is sized to contain 55 cc of liquid. It will be appreciated, however, that the syringe barrel 12 may be any size for containing a desirable volume of liquid. Furthermore, the larger syringe barrels may also be referred to as "cartridges" or "cartridge barrels." In this respect, the terms "syringe" and "cartridge" are not intended to limit the invention to any particular volume or barrel.

The first end 14 of the barrel 12 includes a first connector 26 adapted to receive a corresponding second connector 28 provided on the dispensing tip 22, such that the dispensing tip 22 may be coupled to the first end 14 of the barrel 12. The second end 16 of the barrel 12 includes an opening 30 (see FIG. 3A) and has a radially outwardly extending flange 32. A pair of oppositely disposed tabs or ears 34, 36 extend radially outward from the flange 32, in opposite directions, to facilitate securing an adapter 38 for coupling the syringe 10 to an actuator, such as a source of a pressurized gas 39. The barrel 12, the dispensing tip 22, the first connector 26, the adapter 38, and portions of the piston 20 are described in additional detail in co-pending U.S. patent application Ser. No. 11/761,678 filed Jun. 12, 2007, assigned to the assignee of the present invention, and the disclosure of which is hereby incorporated by reference herein.

An exemplary embodiment of the piston 20 includes a distal end 40 configured to force a liquid material 42 (see FIG. 3B) through the first end 14 of the barrel 12 and into the dispensing tip 22. The distal end 40 of the piston 20 mates with the first end 14 of the barrel 12 to force the liquid material 42 into the dispensing tip 22. A proximal, opposite end 44 of the piston 20 is exposed to the pressurized gas 39, whereby the piston 20 may be actuated in a direction from the second end 16 of the barrel 12 toward the first end 14 of the barrel 12. For example, the pressurized gas 39 may be pressurized air provided in a typical shop or manufacturing setting.

Figure 3A:
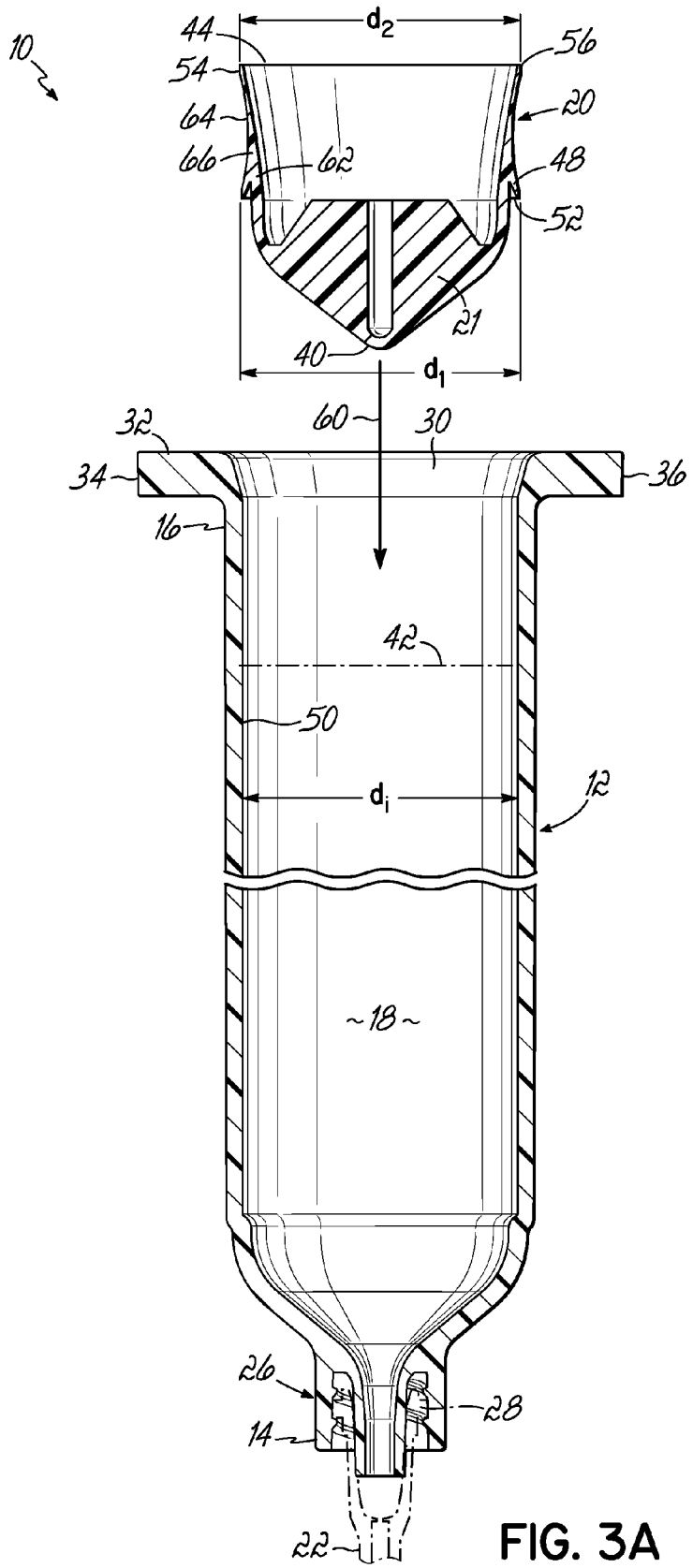
FIG. 3A is a cross-sectional view illustrating a piston prior to insertion within a syringe barrel.

As shown in FIG. 3A, at least one first circumferential wiper seal 48 extends radially outwardly from the piston 20 to engage an inner surface 50 of the barrel 12 and seal the first wiper seal 48 against the inner surface 50. The first wiper seal 48 is positioned on the piston 20 between the distal and proximal ends 40, 44. In an exemplary embodiment, the first wiper seal 48 is in the form of a flange or skirt having a first lip 52 extending circumferentially around the body 21 of the piston 20. In addition, a second wiper seal 54 is positioned at the proximal end 44 on the piston 20, and may be formed generally the same as the first wiper seal 48 with a second lip 56 to engage the inner surface 50 of the barrel 12. With respect to the use of the terms "distal" and "proximal," it will be appreciated that such directions and/or locations are intended to describe relative locations longitudinally along exemplary embodiments of the dispensing syringe 10. It is not intended that these terms or any other spatial references limit the invention to any of the exemplary embodiments described herein.

Figure 3B:
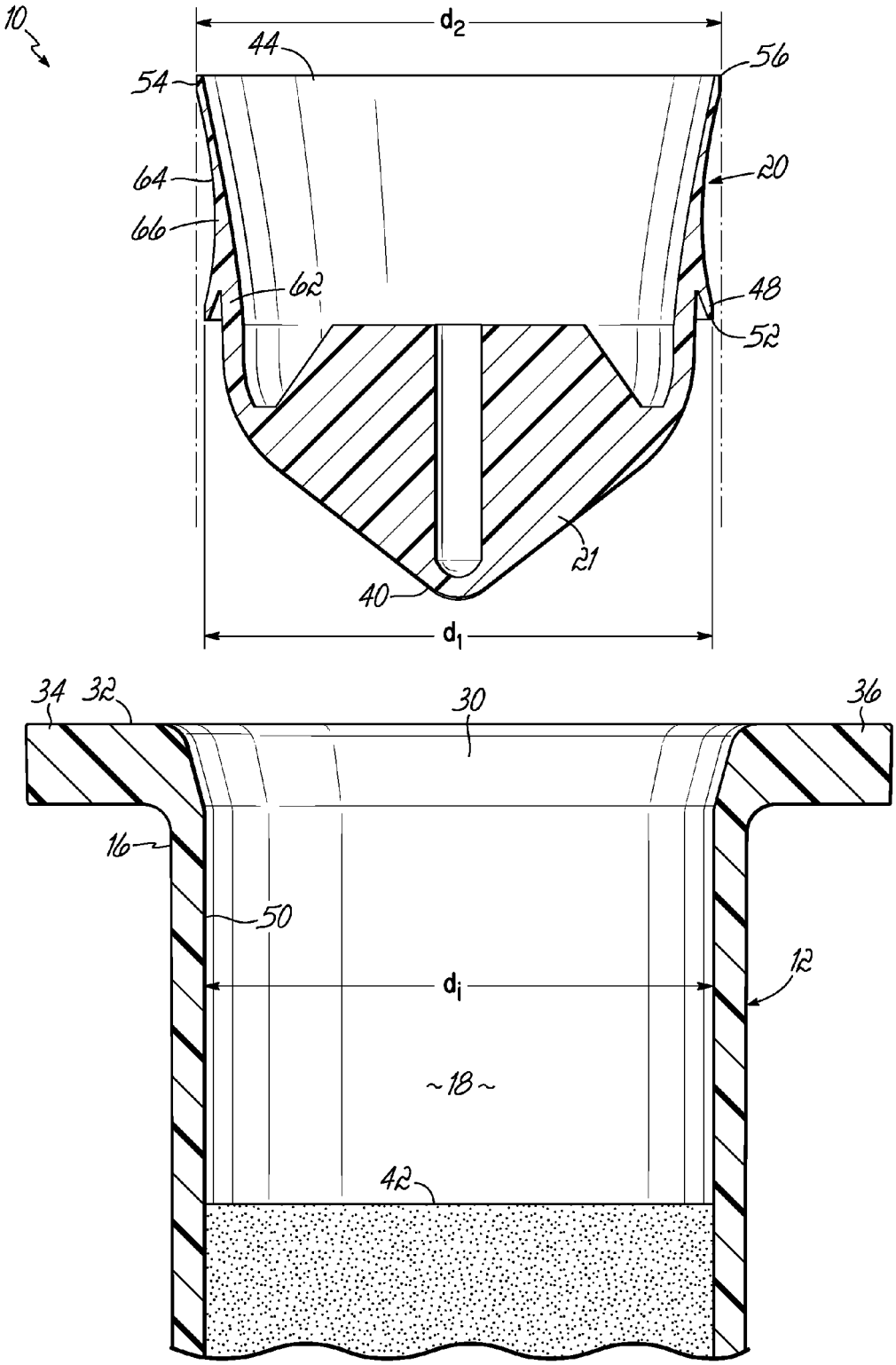
FIG. 3B is an enlarged cross-sectional view similar to FIG. 3A.

With respect to FIG. 3A and FIG. 3B, the inner surface 50 of the interior reservoir 18 is generally cylindrical and has an inner diameter $d_i$. In addition, the first and second lips 52, 56 each have respective first and second outer diameters $d_1$, $d_2$ in a relaxed state as shown outside of the interior reservoir 18. According to an exemplary embodiment, the first and second diameters $d_1$, $d_2$ are each larger than the inner diameter $d_i$ prior to insertion into the interior reservoir 18. As such, when the piston 20 inserts into interior reservoir 18, as indicated by arrow 60, the first and second lips 52, 56 have an interference fit with the inner surface 50. Moreover, the second diameter $d_2$ is at least as large as the first diameter $d_1$. According to an exemplary embodiment, the second diameter $d_2$ is larger than the first diameter $d_1$ as shown in the relaxed state.

Furthermore, the first wiper seal 48 is positioned on a generally rigid portion 62 of the piston 20, and the second wiper seal 54 is positioned on an elastic portion 64 of the piston 20. The generally rigid portion 62 maintains the first wiper seal 48 with a generally constant shape and size regardless of whether or not pressure is applied within the body 21 of the piston 20. In contrast, the elastic portion 64 elastically deforms under the influence of pressure applied within the body 21 and acts upon the second wiper seal 54. As described herein, the term "elastic" generally means that the elastic portion 64 of the piston 20 is flexible such that the elastic portion 64 expands under the influence of a force and then contracts when that force is removed or reduced. In addition, the elastic portion 64 of the piston 20 is more flexible than the rigid portion 62. The material of construction for the piston 20 need not be a material having significant elasticity itself, but may be a flexible material formed as in the present case so as to result in the piston 20 having one or more relatively rigid portions and or more relatively flexible, elastic portions.

According to an exemplary embodiment, the generally rigid and elastic portions 62, 64 are formed of a unitary construction from a same material, such as low-density polyethylene. The elastic portion 64 is thus created by varying the geometry of the piston 20 such that the elastic portion 64 is more elastic than the generally rigid portion 62. As shown more clearly in FIG. 3B, a wall 66 of the piston 20 tapers proximally from the first wiper seal 48 toward the second wiper seal 54 to form the elastic portion 64. Because the wall 66 is thinner than the generally rigid portion 62, the wall 66 is more elastic than the generally rigid portion 62. It will be appreciated, however, that other shapes or various materials may be used alone or in combination for forming the generally rigid and elastic portions 62, 64. For example, the piston 20 may be formed from two or more materials having different material properties related to elasticity. In any case, the first wiper seal 48 is configured to inhibit the liquid material 42 from passing proximally beyond the first wiper seal 48, while the second wiper seal 54 is configured to inhibit pressurized gas 39 from passing distally beyond the second wiper seal 54. In other words, the first wiper seal 48 liquidly seals against the inner surface 50, and the second wiper seal 54 fluidly seals against the inner surface 50 when the proximal end 44 of the piston 20 receives pressurized gas 39.

Figure 3C:
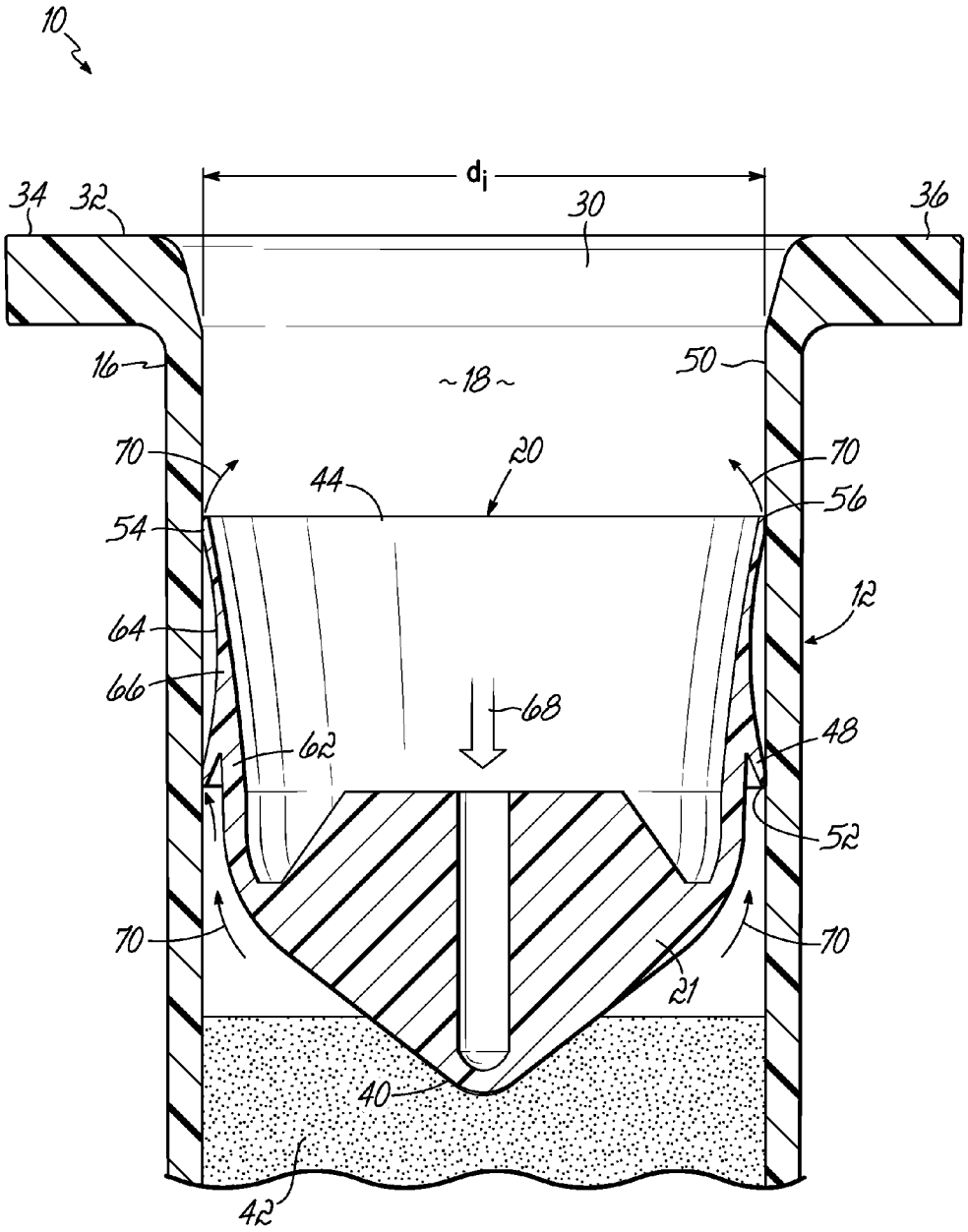
FIG. 3C is an enlarged cross-sectional view illustrating an installation of the piston against a liquid within the syringe barrel.

In use, FIG. 3C shows the piston 20 being inserted into the interior reservoir 18 and against the liquid material 42, as indicated by arrow 68, without the influence of the pressurized gas 39. Entrapped gas, such as air between the liquid material 42 and the piston 20, may flow past each of the first and second wiper seals 48, 54 and evacuate the interior reservoir 18, as indicated by arrows 70. According to an exemplary embodiment, neither the first wiper seal 48 nor the second wiper seal 54 include passages, such as vents, micro-vents, flow channels, or increased clearances for encouraging the flow of entrapped gas 70 from the interior reservoir 18. Rather, the entrapped gas 70 tends to belch past the first and second wiper seals 48, 54 as the volume containing the liquid material 42 within the interior reservoir 18 decreases. Alternatively, the first wiper seal 48 may include passages (not shown), such as vents, micro-vents, flow channels, or increased clearances in combination with elastic portion 64 to further encourage the flow of entrapped gas 70. The passages (not shown) provide for the flow of entrapped gas 70, but generally fill with the liquid material 42 once the entrapped gas 70 is removed to dynamically seal the liquid material 42 within the interior reservoir 18. In any case, once the entrapped gas 70 is generally removed from between the piston 20 and the liquid material 42, the distal end 40 of the piston 20 is positioned against the liquid material 42 and the first wiper seal 48 seals the liquid material 42 within the barrel 12.

Figure 3D:
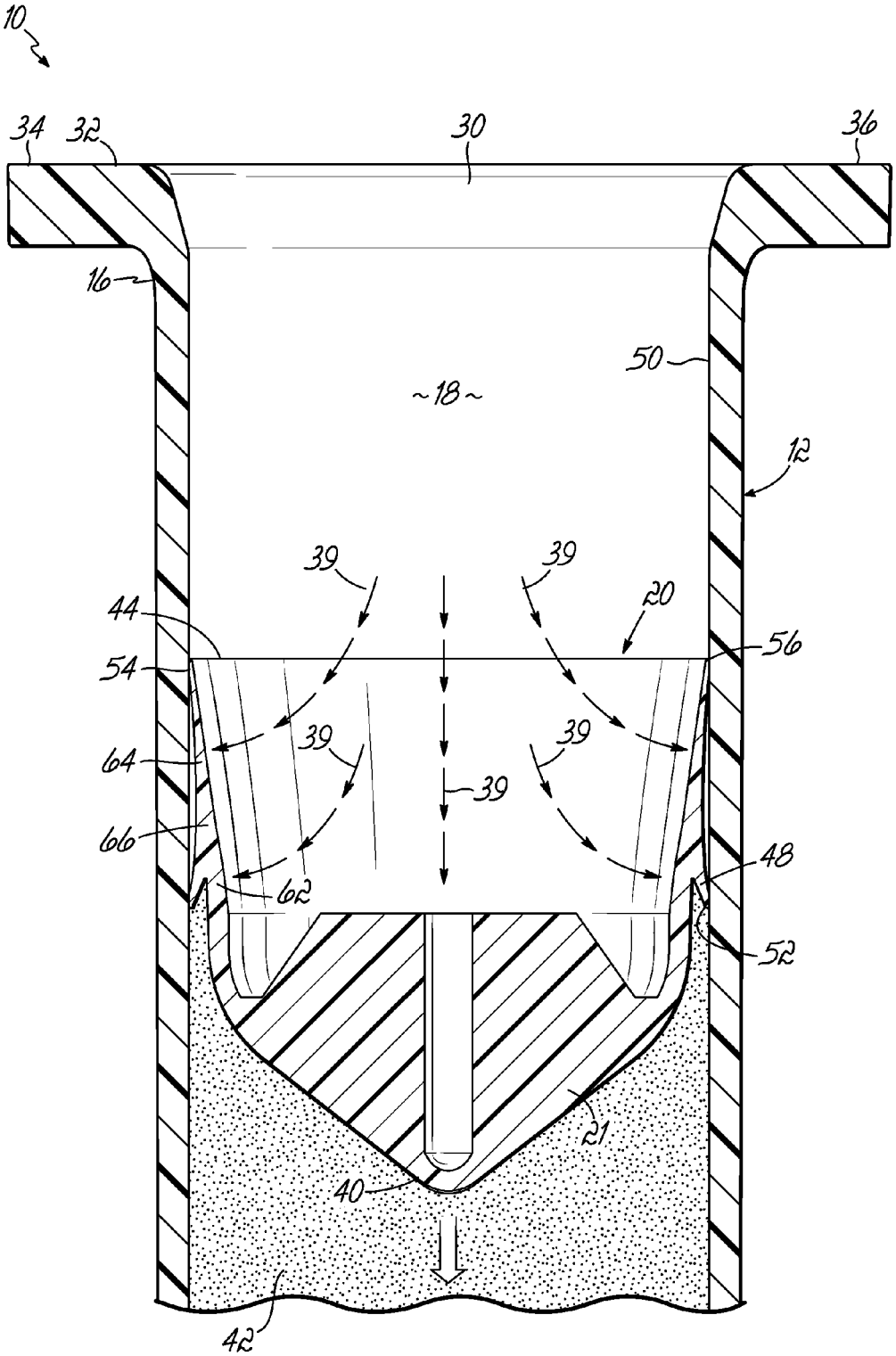
FIG. 3D is an enlarged cross-sectional view illustrating the piston and the syringe barrel in use with a pressurized gas.

FIG. 3D shows the pressurized gas 39 moving distally along the barrel 12 until being received by the proximal end 44 of the piston 20. In turn, the pressurized gas 39 acts on the piston 20 in two distinct ways. First, the pressurized gas 39 forces the distal end 40 against the liquid material 42 for discharging the liquid material 42 from the dispensing syringe 10. Second, the pressurized gas 39 applied to the elastic portion 64 expands the elastic portion 64 to force the second wiper seal 54 against the inner surface 50. According to an exemplary embodiment, the second wiper seal 54 compresses against the inner surface 50. The second wiper seal 54 then distally expands to contact the inner surface 50 with an increased pressure and an increased surface area to fluidly seal against the pressurized gas 39. Of course, once the source of pressurized gas 39 ceases to deliver the pressurized gas 39 to the elastic portion 64, the elastic portion 64 contracts and the second wiper seal 54 contacts the inner surface 50 with a reduced pressure and a reduced surface area as shown in FIG. 3C. In this respect, the type of seal provided by the second wiper seal 54 may vary depending on the application of the pressurized gas 39. Specifically, the second wiper seal 54 allows the entrapped gas 70 to pass during installation, but fluidly seals against the pressurized gas 39 while discharging the liquid material 42.

Alternatively and according to another exemplary embodiment, the elastic portion 64 may force the second wiper seal 54 against the inner surface 50 with the increased pressure, but without contacting the inner surface 50 with increased surface area. For example, the elastic portion 64 may deform via the pressurized gas 39 as shown in FIG. 3; however, the second wiper seal 54 may simply be forced into the inner wall 50 without expanding distally. Thus, an alternative embodiment of a second wiper seal may be generally rigid and fluidly seal against the pressurized gas 39 with the increased pressure alone.

In any case, the second wiper seal 54 inhibits the pressurized gas 39 from incidentally passing beyond the first wiper seal 48 and between the piston 20 and liquid material 42 as entrapped gas 70. Thus, the distal end 40 is maintained against the liquid material 42 as the piston 20 moves through the interior reservoir 18. Furthermore, an exemplary embodiment of the second wiper seal 54 does not include any passages for releasing entrapped gas 70 along the piston 20 to an ambient environment. After all, the fluidly sealed second wiper seal 54 on the elastic portion 64 of the piston 20 inhibits the build up of entrapped gas 70 that may otherwise lead to the piston 20 bouncing on the entrapped gas 70 during use.

While the present invention has been illustrated by the description of one or more embodiments thereof, and while the embodiments have been described in considerable detail, they are not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method and illustrative examples shown and described. Accordingly, departures may be from such details without departing from the scope of the general inventive concept. What is claimed is:

What is claimed is:

1. A dispensing syringe for use with a pressurized gas, comprising:

a barrel having a first end and a second end, and defining an interior reservoir having an inner surface;

a piston slidably disposed within the interior reservoir, the piston having a distal end, a proximal end, a generally rigid portion, and an elastic portion, the proximal end configured to receive the pressurized gas and move the piston toward the first end in order to decrease a volume of the interior reservoir proximate to the first end of the barrel and discharge a liquid contained therein, the elastic portion configured to expand under the influence of the pressurized gas;

a first circumferentially extending wiper seal positioned on the generally rigid portion of the piston between the distal and proximal ends, the first wiper seal engaging the inner surface such that the first wiper seal liquidly seals against the inner surface and inhibits the liquid within the interior reservoir from flowing proximally beyond the first wiper seal; and a second circumferentially extending wiper seal positioned on the elastic portion of the piston proximally from the first wiper seal, the elastic portion being more flexible than the generally rigid portion such that the elastic portion forces the second wiper seal to contact the inner surface with an increased pressure and an increased surface area to fluidly seal against the inner surface for inhibiting pressurized gas from flowing distally beyond the second wiper seal in order to reduce piston bounce.

2. The dispensing syringe of claim 1 wherein the interior reservoir has an inner diameter and the first and second wiper seals have a first diameter and a second diameter in a relaxed state, respectively, the first diameter and the second diameter are larger than the inner diameter, and the second diameter of the second wiper seal is at least the same size as the first diameter of the first wiper seal.

3. The dispensing syringe of claim 1 wherein the elastic portion further comprises a wall, and the wall is generally thinner than the generally rigid portion such that the wall is more elastic than the generally rigid portion.

4. The dispensing syringe of claim 3 wherein the elastic and generally rigid portions of the piston are formed from a same material.

5. The dispensing syringe of claim 3 wherein the wall tapers toward the proximal end of the piston.

6. The dispensing syringe of claim 1 wherein the elastic portion is formed from an elastic material and the generally rigid portion is formed from a different, generally rigid material.

7. The dispensing syringe of claim 1 further comprising:

said first wiper seal having a radially outwardly flared skirt with a first lip defining an open end facing toward the first end of the piston; and said second wiper seal having a radially outwardly flared skirt with a second lip defining an open end facing toward the second end of the piston.

8. A piston for use with a dispensing syringe and a pressurized gas, the dispensing syringe having a barrel with a first end and a second end, and defining an interior reservoir having an inner surface, the piston comprising:

a body configured to be slidably positioned within the interior reservoir of the barrel, the body having a distal end, a proximal end, a generally rigid portion, and an elastic portion, the proximal end configured to receive the pressurized gas such that the body moves toward the first end in order to decrease a volume of the interior reservoir proximate to the first end of the barrel and discharge a liquid contained therein, the elastic portion configured to expand under the influence of the pressurized gas;

a first circumferentially extending wiper seal positioned on the generally rigid portion of the body between the distal and proximal ends, the first wiper seal configured to liquidly seal against the inner surface and inhibit the liquid within the interior reservoir from flowing proximally beyond the first wiper seal; and a second circumferentially extending wiper seal positioned on the elastic portion of the body proximally from the first wiper seal, the elastic portion being more flexible than the generally rigid portion and configured to force the second wiper seal to contact the inner surface with an increased pressure and an increased surface area to fluidly seal against the inner surface for inhibiting pressurized gas from flowing distally beyond the second wiper seal in order to reduce piston bounce.

9. The piston of claim 8 wherein the interior reservoir has an inner diameter and the first and second wiper seals have a first diameter and a second diameter in a relaxed state, respectively, the first and second diameters are configured for an interference fit with the inner diameter, and the second diameter of the second wiper seal is at least the same size as the first diameter of the first wiper seal.

10. The piston of claim 8 wherein the elastic portion further comprises a wall, and the wall is generally thinner than the generally rigid portion such that the wall is more elastic than the generally rigid portion.

11. The piston of claim 10 wherein the elastic and generally rigid portions of the body are formed from a same material.

12. The piston of claim 10 wherein the wall tapers toward the proximal end of the body.

13. The piston of claim 8 wherein the elastic portion is formed from an elastic material and the generally rigid portion is formed from a different, generally rigid material.

14. The piston of claim 8 further comprising:

said first wiper seal having a radially outwardly flared skirt with a first lip defining an open end facing toward the first end of the body; and said second wiper seal having a radially outwardly flared skirt with a second lip defining an open end facing toward the second end of the body.

* * * * *